United States Patent [19]

Gerzon

[11] 4,414,430

[45] Nov. 8, 1983

[54] DECODERS FOR FEEDING IRREGULAR LOUDSPEAKER ARRAYS

[75] Inventor: Michael A. Gerzon, Oxford, England

[73] Assignee: National Research Development Corporation, London, England

[21] Appl. No.: 305,623

[22] PCT Filed: Feb. 12, 1981

[86] PCT No.: PCT/GB81/00018

§ 371 Date: Sep. 24, 1981

§ 102(e) Date: Sep. 24, 1981

[87] PCT Pub. No.: WO81/02502

PCT Pub. Date: Sep. 3, 1981

[30] Foreign Application Priority Data

Feb. 23, 1980 [GB] United Kingdom ..... 8006174

[51] Int. Cl.[3] ..... H04R 5/04

[52] U.S. Cl. ..... 381/22

[58] Field of Search ..... 179/1 GD, 1 GQ

[56] References Cited

U.S. PATENT DOCUMENTS 4,095,049 6/1978 Gerzon ..... 179/1 GQ

FOREIGN PATENT DOCUMENTS 1369813 10/1974 United Kingdom .
1494751 12/1977 United Kingdom .
1548674 7/1979 United Kingdom .
1550627 8/1979 United Kingdom .

OTHER PUBLICATIONS

Gerzon, "Surround Sound Decoders-6", Wireless World, vol. 83, No. 1499, Jul. 1977, pp. 43-47, S74520140g.

Gerzon, "Surround Sound Decoders-7", Wireless World, vol. 83, No. 1500, Aug. 1977, pp. 69-73, S74660033m.

*Primary Examiner*—A. D. Pellinen

*Attorney, Agent, or Firm*—Young & Thompson

[57] ABSTRACT

A decoder is provided for feeding an irregular array of m (being three or more) pairs of diametrically opposite loudspeakers, each loudspeaker being disposed at an equal distance r from a common reference point. The decoder incorporates a WXY circuit 10 for producing output signals W, X, Y and −jW from the input signals, and shelf filters 12, 14, 16 and 22 and high-pass filters 18, 20 and 24 for producing output signals W′, X′, Y′ and $-jW_i''$. In addition the decoder includes an amplitude matrix circuit 26 for producing signals $S_i+$ and $S_i-$, to be fed to the loudspeakers of each pair, which satisfy particular gain requirements, whereby the outputs of the loudspeakers are adapted to irregular positioning of the loudspeakers which may be dictated by room geometry. A decoder is also provided for feeding a three-dimensional loudspeaker layout.

24 Claims, 7 Drawing Figures

DECODERS FOR FEEDING IRREGULAR LOUDSPEAKER ARRAYS

Figure 1:
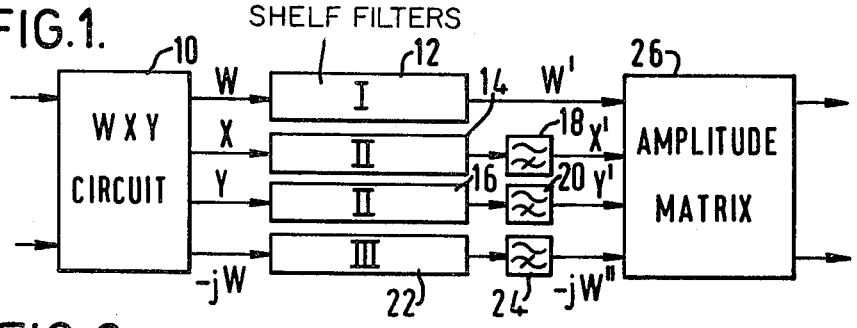

This invention relates to sound reproduction systems and more particularly to sound reproduction systems which enable a listener to distinguish sound from sources extending over 360° of azimuth. Such systems are hereinafter called surround sound systems. The invention is also applicable to surround sound systems which, in addition, enable the listener to distinguish sound from sources at different heights.

Surround sound systems for loudspeaker arrays in which the loudspeakers are disposed at the corners of a geometrically regular polygon, or, in the case of with-height surround sound systems, the corners of a regular solid, are already known. Such systems are also known for loudspeaker arrays where the loudspeakers are disposed to corners of a rectangle or rectangular cuboid. The present invention is concerned with the provision of a decoder for use in a surround sound system where the loudspeakers are disposed at other locations. Such loudspeaker arrays will hereinafter be referred to as irregular loudspeaker arrays and it should be understood that this term excludes rectangular and rectangular cuboid arrays in spite of the fact that these are, in strict mathematical terms, not regular shapes.

It has already been proposed in U.K. Pat. No. 1,411,994 to feed each loudspeaker of an irregular array with a signal having an effective directional pick-up characteristic for encoded sounds which points in the direction of that loudspeaker. However, the results achieved with irregular arrays are not psychoacoustically correct.

Two important theories of sound localisation are the "Makita" theory and the "energy vector" theory. The "Makita" theory is applicable to frequencies less than 700 Hz and has some applicability up to about 1500 Hz. According to this theory, for a loudspeaker array with n loudspeakers all placed at the same distance r from a central reference point at positions indicated by respective rectangular cartesian co-ordinates ($x_i$, $y_i$, $z_i$) where $i=1, 2, \ldots, n$, the localisation of the sound fed to these loudspeakers, where $g_i$ is the complex gain of the sound emerging from the ith loudspeaker, is given by:

$$w = \sum_{i=1}^{n} g_i \tag{1}$$

$$x_o = Re\left\{\left(\sum_{i=1}^{n} g_i x_i\right) / rw\right\} \tag{2}$$

$$y_o = Re\left\{\left(\sum_{i=1}^{n} g_i y_i\right) / rw\right\} \tag{3}$$

$$z_o = Re\left\{\left(\sum_{i=1}^{n} g_i z_i\right) / rw\right\} \tag{4}$$

where "Re" means "the real part of" and ($x_o$, $y_o$, $z_o$) is a vector pointing to the apparent localisation of the sound with respect to the origin of the cartesian co-ordinates.

For frequencies in the range from approximately 700 Hz to 5 kHz, the "energy vector" theory of localisation is appropriate, the apparent sound direction being the direction of the vector sum of a set of vectors, one pointing to each loudspeaker with a respective length equal to the energy gain of the sound at that loudspeaker. Then, with a loudspeaker array as described above, the energy vector localisation is the direction of the vector ($x_E$, $y_E$, $z_E$) given by:

$$x_E = \left(\sum_{i=1}^{n} |g_i|^2 x_i\right) / \left(\sum_{i=1}^{n} |g_i|^2 r\right) \tag{5}$$

$$y_E = \left(\sum_{i=1}^{n} |g_i|^2 y_i\right) / \left(\sum_{i=1}^{n} |g_i|^2 r\right) \tag{6}$$

$$z_E = \left(\sum_{i=1}^{n} |g_i|^2 z_i\right) / \left(\sum_{i=1}^{n} |g_i|^2 r\right) \tag{7}$$

The present invention is concerned with the provision of a decoder for an irregular loudspeaker layout which satisfies both the "Makita" and the "energy vector" theories.

According to the invention, there is provided a decoder for feeding an irregular array (as hereinbefore defined) of m (being three or more) pairs of diametrically opposite loudspeakers, each loudspeaker being disposed substantially at an equal distance r from a common reference point, comprising an amplitude matrix circuit so arranged that, in operation, the sum of the signals $S_i^+$ and $S_i^-$ fed to the loudspeakers of each pair is the same for all pairs of loudspeakers, and such that, if the ith pair of loudspeakers has cartesian coordinates ($x_i$, $y_i$, $z_i$) and ($-x_i$, $-y_i$, $-z_i$) with respect to rectangular cartesian axes x, y and z at the reference point, $$S_i^+ = W' + \alpha_i X' + \beta_i Y' + \gamma_i Z' - \delta_i j W_i''$$

$$S_i^- = W' - \alpha_i X' - \beta_i Y' - \gamma_i Z' + \delta_i j W_i''$$

where W' is a signal representative of the acoustical pressure at the reference point and is independent of i, X', Y' and Z' are signals representative of the components of a desired acoustical velocity along the x, y and z axes and are independent of i, $jW_i''$ is any signal bearing a 90° phase relationship to W' for all encoded sound directions, and $\alpha_i$, $\beta_i$, $\gamma_i$, and $\delta_i$ are real gain coefficients such that $\alpha_i$, $\beta_i$, and $\gamma_i$ substantially satisfy the following matrix equation:

$$KM = \frac{k\,mr\,I}{\sqrt{2}}$$

where K is the m×3 matrix:

$$\begin{pmatrix} x_1 & x_2 & & x_m \\ y_1 & y_2 & \cdots & y_m \\ z_1 & z_2 & & z_m \end{pmatrix},$$

$M$ is the $3 \times m$ matrix of coefficients:

$$\begin{pmatrix} \alpha_1 & \beta_1 & \gamma_1 \\ \alpha_2 & \beta_2 & \gamma_2 \\ \cdot & \cdot & \cdot \\ \alpha_m & \beta_m & \gamma_m \end{pmatrix},$$

I is the identity matrix:

$$\begin{pmatrix} 1 & 0 & 0 \\ 0 & 1 & 0 \\ 0 & 0 & 1 \end{pmatrix}$$ for a three-dimensional loudspeaker layout or $$\begin{pmatrix} 1 & 0 & 0 \\ 0 & 1 & 0 \\ 0 & 0 & 0 \end{pmatrix}$$ for a two-dimensional horizontal loudspeaker layout, and k is a positive real constant which may be frequency dependent. It can be shown that the condition $S_i^+ + S_i^- = 2W'$ for all i is sufficient to ensure that the Makita and energy vector localisations always coincide.

It should be understood that, although $jW_i''$ may be the same for all pairs of diametrically opposite loudspeakers, this signal may also differ for different loudspeaker pairs provided that each signal bears a 90° phase relationship to W' for all encoded sound directions.

When the invention is to be applied to a decoder having a "WXY" circuit, as described in U.K. Pat. No. 1,494,751, having outputs W, X, Y such that the intended direction of sound localisation is an azimuth $\phi$, measured anticlockwise from the x-axis, where:

$$\cos\phi : \sin\phi = Re(X/W) : Re(Y/W) \quad \ldots (8)$$

then a decoder in accordance with the invention for feeding an irregular horizontal array of loudspeakers consisting of m diametrically opposite pairs of loudspeakers (where m is 3 or more) produces signals to be fed to the loudspeakers of each pair given by $S_i^+$ and $S_i^-$, where $i = 1, 2 \ldots, m$ and $$S_i^+ = W' + \alpha_i X' + \beta_i Y' - \delta_i j W_i'' \quad \ldots (9)$$

$$S_i^- = W' - \alpha_i X' - \beta_i Y' + \delta_i j W_i'' \quad \ldots (10)$$

where $\alpha_i$, $\beta_i$ and $\delta_i$ are real gains, arranged such that the apparent sound localisation according to Makita's theory is substantially equal to the aximuth $\phi$. It will be understood that, in equation (8), the convention has been used of letting the symbols W, X and Y representing signals also denote the complex gains of these signals for a given single encoded sound direction.

If desired, the gains of the signals W, X and Y may be altered provided that the gains in the X and Y channels are identical and the phase responses in all three channels are identical. Gains applied may be frequency-dependent. A fourth signal path is provided for conveying a signal proportional to $-jW_i''$ which is used to apply directional biasing as described in U.K. Patent No. 1,550,627, the biasing signals applied to the loudspeakers of each pair being of equal magnitude but opposite polarity.

Figure 2:
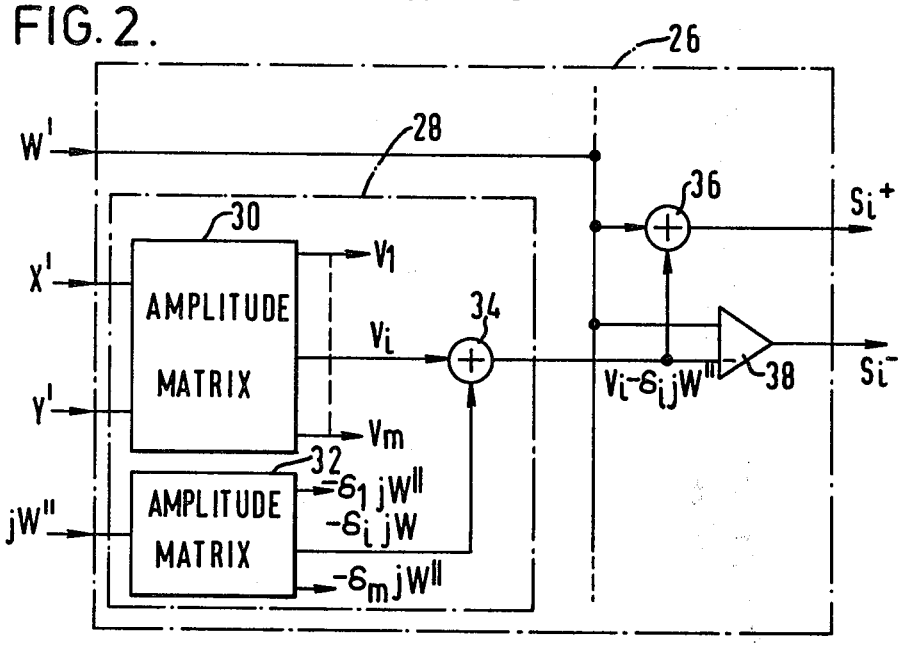
Figure 3:
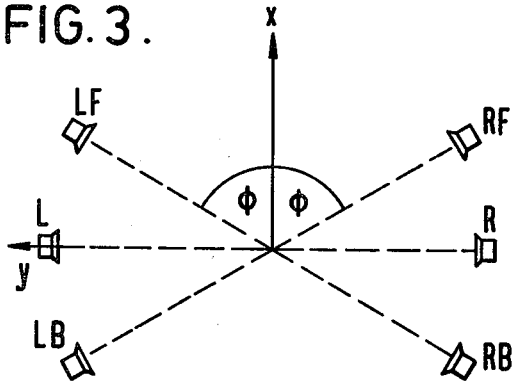
Figure 4:
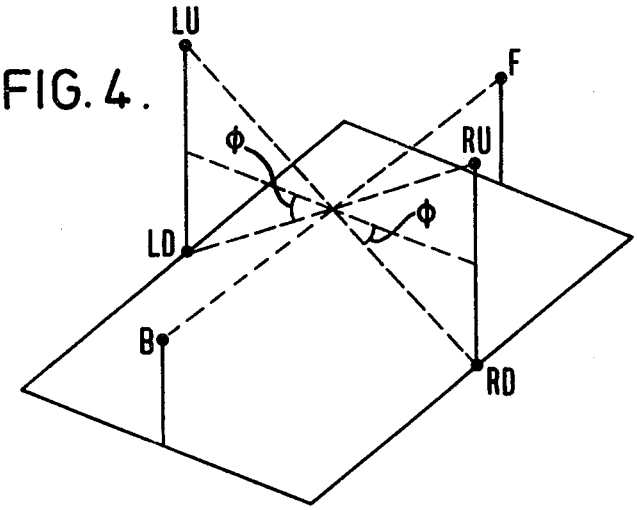
Figure 5:
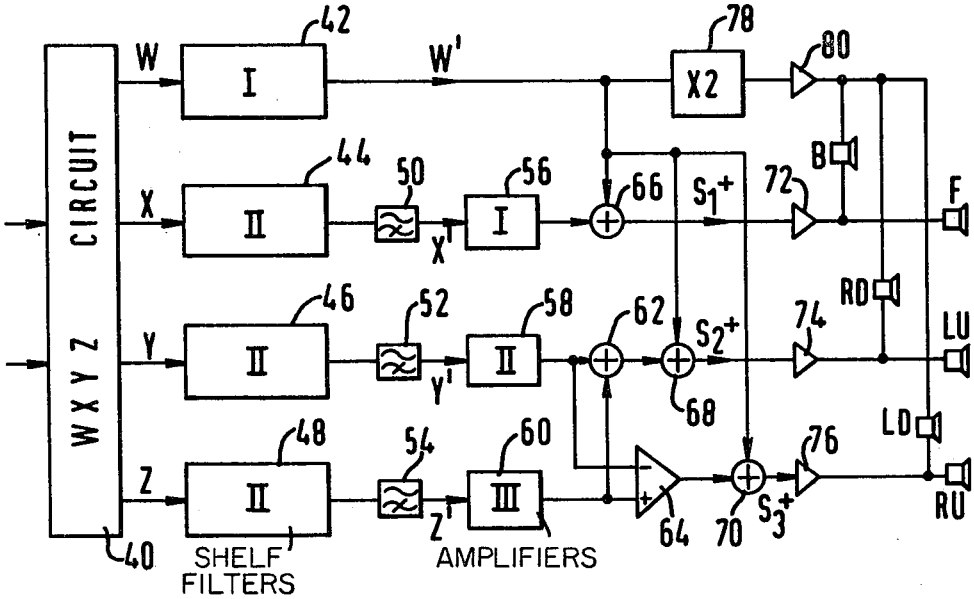
Figure 6:
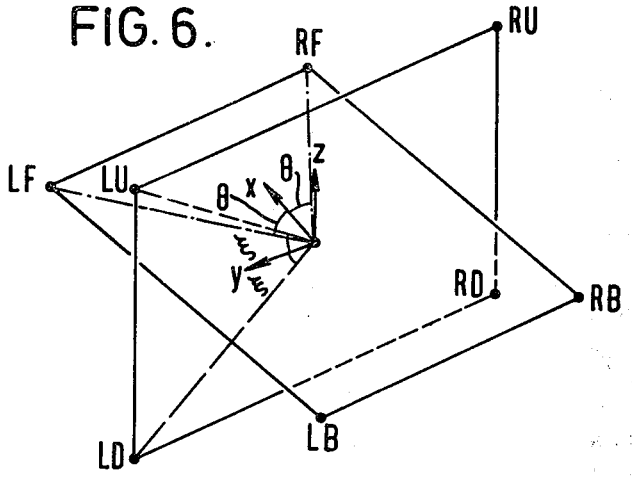
Figure 7:
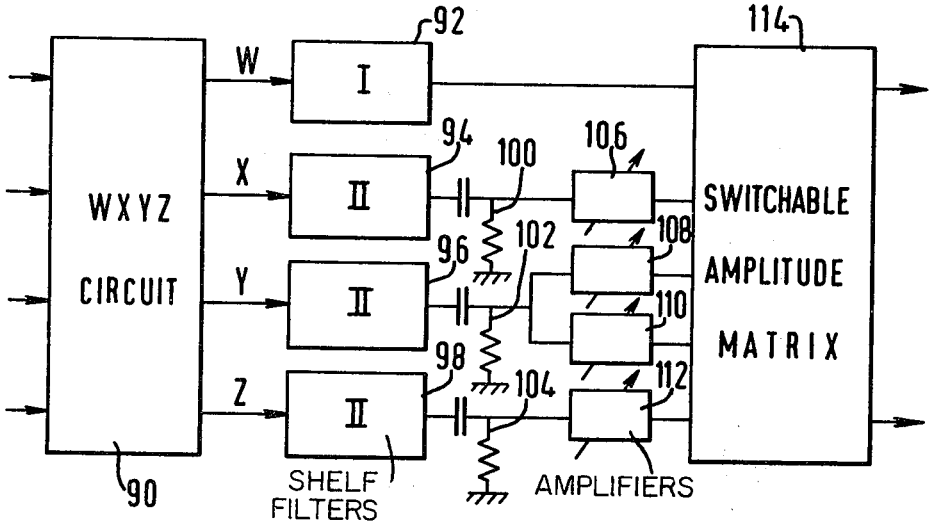

Embodiments of the invention will now be described by way of example with reference to the accompanying drawings, in which:

FIG. 1 is a block schematic diagram of a decoder for a horizontal surround sound decoder in accordance with the invention, FIG. 2 is a block schematic diagram of part of an amplitude matrix for the decoder shown in FIG. 1, FIG. 3 shows an irregular hexagonal loudspeaker array suitable for use with the decoder shown in FIG. 1, FIG. 4 shows an irregular octahedral loudspeaker array, FIG. 5 is a block schematic diagram of a decoder in accordance with the invention for use with the loudspeaker array shown in FIG. 4, FIG. 6 is an irregular three dimensional array of eight loudspeakers, and FIG. 7 is a block schematic diagram of a decoder in accordance with the invention for use with a loudspeaker array as shown in FIG. 4 or 6.

Referring to FIG. 1, a decoder for a horizontal surround sound system has a WXY circuit 10 arranged to receive coded input signals and produce output signals W, X and Y. In addition, the circuit 10 produces a second output W phase-shifted by 90° to give the signal $-jW$. The signal W is applied to a type I shelf filter 12 to produce the signal W'. The signals X and Y are applied to respective type II shelf filters 14 and 16 and respective high-pass filters 18 and 20 to produce the signals X' and Y', and the signal $-jW$ is applied to a type III shelf filter 22 and a high-pass filter 24 to produce the signal $-jW''$. The shelf filters 12, 14 and 16 have substantially identical phase responses, and are used to achieve a different ratio of velocity to pressure information at the reference listening position at low frequencies, for example less than 400 Hz, and at high frequency, for example greater than 700 Hz. The high-pass filters 18, 20 and 24 are used to compensate for curvature of the sound field due to finite loudspeaker distance and optimally have their −3 dB points at a frequency (53/r) Hz where r is the distance of the loudspeakers from the reference point in meters. The signal $-jW''$ is used to apply directional biasing. The nature and functions of the various filters 12 to 24 is more fully described in U.K. Pat. Nos. 1,494,751, 1,494,752 and 1,550,627.

The signals W', X', Y', $-jW''$ are applied to an amplitude matrix 26. Referring to FIG. 2, the matrix 26 comprises a 3 × m amplitude matrix 28, to which the signals X', Y' and $-jW''$ are applied and which produces m outputs, $V_1 - \delta_1 jW''$ to $V_m - \delta_m jW''$, one for each pair of loudspeakers. The matrix 28 comprises a 2 × m amplitude matrix 30, to which the signals X' and Y' are applied and which produces m outputs $V_1$ to $V_m$, a 1 × m amplitude matrix 32, to which the signal $-jW''$ is applied and which produces m directional biasing signals $-\delta_1 jW''$ to $-\delta_m jW''$, and m addition circuits 34 for adding $-\delta_i jW''$ to $V_i$ to produce a respective signal $V_i - \delta_i jW''$ for each pair of loudspeakers, where the real coefficients $\delta_i$ are chosen to achieve the desired degree of directional biasing. In addition, the matrix 26 includes an addition circuit 36 and a subtraction circuit 38 for each pair of loudspeakers of which only the circuits for the ith loudspeaker pair are shown in FIG. 2. The signal W' and the output $V_i - \delta_i jW''$ are applied to the addition circuit 36, the output of which comprises the signal:

$$S_i^+ = W' + V_i - \delta_i jW'' \quad \ldots (11)$$

and forms a feed signal for one of the loudspeakers of the ith pair. The signal W' is also applied to the positive input of the subtractor 38 and the signal $V_i - \delta_i jW''$ from the amplitude matrix 34 is applied to the negative input thereof, the output of which is given by:

$$S_i^- = W' - V_i + \delta_i jW'' \quad \ldots (12)$$

and forms the feed signal for the other loudspeaker of the ith pair.

It will be understood that, if no directional biasing is required, then $\delta_i=0$ for every i, and that in that case all parts of the circuit of FIG. 1 and FIG. 2 concerned with the handling of the signal $-jW$ may be omitted. Also, it will be understood that any amplitude matrix producing outputs identical to those of the circuit 26 falls within the scope of the invention, and that, in particular, it may often by convenient to perform the addition of the bias signal $-jW''$ prior to the amplitude matrix 28 rather than subsequent to it.

Since the amplitude matrix 28 having matrix coefficients such that:

$$V_i = \alpha_i X' + \beta_i Y' \tag{13}$$

that is $$\begin{pmatrix} V_1 \\ \cdot \\ \cdot \\ \cdot \\ V_m \end{pmatrix} = \begin{pmatrix} \alpha_1 & \beta_1 \\ \cdot & \cdot \\ \cdot & \cdot \\ \alpha_m & \beta_m \end{pmatrix} \begin{pmatrix} X' \\ Y' \end{pmatrix} \tag{14}$$

is required to satisfy Makita localisation criteria of Equation (8), the coefficients $\alpha_i$ and $\beta_i$ of the matrix must satisfy the equations:

$$\sum_{i=1}^{m} \alpha_i x_i = \sum_{i=1}^{m} \beta_i y_i = mr/\sqrt{2} \tag{15}$$

$$\sum_{i=1}^{m} \alpha_i y_i = \sum_{i=1}^{m} \beta_i x_i = 0 \tag{16}$$

Since $S_i^+ + S_i^- = 2W'$ for such an amplitude matrix, it also follows that the energy vector localisation coincides with the Makita localisation for this amplitude matrix.

If we write the $2\times m$ matrix of the coefficients:

$$\begin{pmatrix} \alpha_1 & \beta_1 \\ \cdot & \cdot \\ \cdot & \cdot \\ \alpha_m & \beta_m \end{pmatrix}$$

of the matrix 28 as M and the $m\times 2$ matrix $$\begin{pmatrix} x_1 & x_m \\ \cdots & \\ y_1 & y_m \end{pmatrix}$$

as K, then the Equations 15 and 16 can be rewritten in matrix form as:

$$KM = \frac{1}{\sqrt{2}} mrI \tag{17}$$

where I is the $2\times 2$ identity matrix and r is the distance of the loudspeakers from the reference listening position as before.

In practice, any positive real multiple k of the matrix M satisfying Equation 17 may be used, that is one can multiply all gains $\alpha_i$, $\beta_i$ by a fixed positive gain k. However, it is preferable to use a multiple k of M which also ensures the condition:

$$k^2\{(Re(X'/W'))^2+(Re(Y'/W'))^2\}=2 \tag{18}$$

is satisfied, since, if this condition is met, not only the Makita theory, but also other low frequency localisation theories are satisfied. This last mentioned condition is satisfied, for example, when W' has unity gain for all sounds, and X' has gain $\sqrt{2}\cos\theta$ and Y' has gain $\sqrt{2}\sin\theta$ for a sound originating from an azimuth $\theta$ measured anticlockwise from the front direction and when k equals 1.

The constant k may be implemented by means of gain or shelf filter circuits affecting the signals X', Y' and W' prior to the final output matrix circuitry, and additional changes of gain, phase response and frequency response may be applied to these signals, provided that all the signals are affected equally by these additional changes.

A convenient way of devising a matrix M satisfying the condition:

$$KM = \frac{k}{\sqrt{2}} mrI \tag{19}$$

, and therefore giving correct localisation, is as follows. For each pair of loudspeakers:

$$\begin{pmatrix} \alpha_i \\ \beta_i \end{pmatrix} = \frac{k}{\sqrt{2}} mr \left( \sum_{h=1}^{m} \begin{pmatrix} x_h^2 & x_h y_h \\ x_h y_h & y_h^2 \end{pmatrix} \right)^{-1} \begin{pmatrix} x_i \\ y_i \end{pmatrix} \tag{20}$$

where the power $-1$ indicates a matrix inverse.

The application of Equation 20 to the irregular hexagonal loudspeaker array shown in FIG. 3 will now be described. The array of FIG. 3 consists of a due left loudspeaker L, a due right loudspeaker R and four loudspeakers LB, LF, RF and RB placed at respective azimuths $180°-\phi$, $\phi$, $-\phi$, and $-180°+\phi$ measured anticlockwise from due front. Putting due front as the x direction, due left as the y direction and $S_1^+$, $S_2^+$, $S_3^+$, $S_1^{1-}$, $S_2^-$, $S_3^-$ equal to the signals fed to the respective loudspeakers LB, L, LF, RF, R, RB we have:

$$(x_1, y_1) = (-r\cos\phi, r\sin\phi) \tag{21}$$
$$(x_2, y_2) = (0, r) \tag{22}$$
$$(x_3, y_3) = (r\cos\phi, r\sin\phi) \tag{23}$$

so that:

$$\begin{pmatrix} \alpha_i \\ \beta_i \end{pmatrix} = \frac{3r^{-1}k}{\sqrt{2}} \begin{pmatrix} 2\cos^2\phi & 0 \\ 0 & 1+2\sin^2\phi \end{pmatrix}^{-1} \begin{pmatrix} x_i \\ y_i \end{pmatrix} \tag{24}$$

$$= \frac{r^{-1}k}{\sqrt{2}} \begin{pmatrix} \frac{3}{2\cos^2\phi} & 0 \\ 0 & \frac{3}{1+2\sin^2\phi} \end{pmatrix} \begin{pmatrix} x_i \\ y_i \end{pmatrix}$$

From Equation 24:

$$M = \begin{pmatrix} \alpha_1 & \beta_1 \\ \alpha_2 & \beta_2 \\ \alpha_3 & \beta_3 \end{pmatrix} = \frac{k}{\sqrt{2}} \begin{pmatrix} \frac{-3}{2\cos\phi} & \frac{3\sin\phi}{1+2\sin^2\phi} \\ 0 & \frac{3}{1+2\sin^2\phi} \\ \frac{3}{2\cos\phi} & \frac{3\sin\phi}{1+2\sin^2\phi} \end{pmatrix} \tag{25}$$

and the amplitude matrix 28 is FIGS. 1 and 2 feeds the following signals to the loudspeakers of FIG. 3:

$$S_1^+ = W' - \frac{3k}{2\sqrt{2}\cos\phi} X' + \frac{3k\sin\phi}{\sqrt{2}\,(1+2\sin^2\phi)} Y' \quad (26)$$

$$S_2^+ = W' + \frac{3k}{\sqrt{2}\,(1+2\sin^2\phi)} Y' \quad (27)$$

$$S_3^+ = W' + \frac{3k}{2\sqrt{2}\cos\phi} X' + \frac{3k\sin\phi}{\sqrt{2}\,(1+2\sin^2\phi)} Y' \quad (28)$$

$$S_1^- = W' + \frac{3k}{2\sqrt{2}\cos\phi} X' - \frac{3k\sin\phi}{\sqrt{2}\,(1+2\sin^2\phi)} Y' \quad (29)$$

$$S_2^- = W' = \frac{3k}{\sqrt{2}\,(1+2\sin^2\phi)} Y' \quad (30)$$

$$S_3^- = W' - \frac{3k}{2\sqrt{2}\cos\phi} X' - \frac{3k\sin\phi}{\sqrt{2}\,(1+2\sin^2\phi)} Y' \quad (31)$$

The matrix coefficients of the amplitude matrix 30 may have any real value chosen to provide the required directional biasing, if any, or alternatively directional biasing may be achieved by modifying the signals X' and Y' as described in above-mentioned U.S. Pat. No. 1,550,627.

It should be understood that, in all these decoders, the signals X and Y from the WXY circuit 10 may be replaced by two independent real linear combinations of X and Y provided that the amplitude matrix 26 derives from these linear combinations the required output signals $S_i^+$ and $S_i^-$. Moreover, matrices may be combined or rearranged in the circuitry wherever this is of design or constructional convenience so that a part of the output amplitude matrix function might, for example, be combined with the function of the WXY circuit.

It will be appreciated that the gains $\alpha_1$, $\alpha_2$ and $\alpha_3$, $\beta_1$, $\beta_2$ and $\beta_3$ of the above decoder for a hexagonal loudspeaker layout depend on the angle $\phi$, and that it will often be desirable to incorporate means for providing a continuous adjustment of the value of $\phi$ in the decoder circuit. To this end the gains $\alpha_1 = -\alpha_3$ (which result in a signal component $\alpha_1 X' = -\alpha_3 X'$) may be implemented by a first variable gain circuit placed in the X' signal path, the gain $\beta_2$ (which results in a signal component $\beta_2 Y'$) may be implemented by a second variable gain circuit placed in the Y' signal path, and the gains $\beta_1 = \beta_3$ (which result in a signal component $\beta_1 Y' = \beta_3 Y'$) may be implemented by a third variable gain circuit placed in the Y' signal path. Simultaneous adjustment of these three variable gain circuits will then permit the decoder to be adapted to loudspeaker layouts with various different values of $\phi$.

The invention may also be applied to irregular three-dimensional loudspeaker arrays where the loudspeakers are placed in m diametrically opposite pairs at a distance r from the reference listening point. In the following discussion it is assumed that the ith of m pairs of loudspeakers have positions given by the cartesian coordinates ($x_i$, $y_i$, $z_i$) and ($-x_i$, $-y_i$, $-z_i$) and are fed with respective signals $S_i^{30}$ and $S_i^-$. W, X, Y and Z are signals representative respectively of the desired pressure and x-axis, y-axis, and z-axis components of velocity of sound at the reference listening position. Such signals may be subjected to shelf filters having identical phase responses and to RC high-pass filters compensating for loudspeaker distance, analogous to the filters described with reference to FIG. 1, provided only that the filtering on each of the X, Y and Z signal paths is identical, producing modified signals W', X', Y', Z'. Then, in accordance with the invention, the Makita and energy vector localisation give the same direction of sound provided that:

$$S_i^+ + S_i^+ = 2W' \text{ for } i = 1, 2, \ldots, m \quad \ldots (32)$$

In addition, it is often desired that this localisation be at the direction of the point (Re (X/W), Re (Y/W), Re (Z/W)), and in that case the signals $S_i^+$ and $S_i^-$ are given by:

$$S_i^+ = W' + \alpha_i X' + \beta_i Y' + \gamma_i Z' - \delta_i j W_i'' \quad \ldots (33)$$

$$S_i^- = W' - \alpha_i X' - \beta_i Y' - \gamma_i Z' + \delta_i j W_i'' \quad \ldots (34)$$

where $\alpha_i$, $\beta_i$, $\gamma_i$ and $\delta_i$ are real coefficients, where $jW_i''$ is any signal having a 90° phase relation to W' for all sound directions, and where the 3×m matrix:

$$M = \begin{pmatrix} \alpha_1 \beta_1 \gamma_1 \\ \alpha_2 \beta_2 \gamma_2 \\ \cdot \\ \cdot \\ \cdot \\ \alpha_m \beta_m \gamma_m \end{pmatrix} \quad (35)$$

satisfies the matrix equation:

$$KM = \frac{1}{\sqrt{2}} kmrI \quad (36)$$

where k is a positive constant and $$K = \begin{pmatrix} x_1 \ldots x_m \\ y_1 \ldots y_m \\ z_1 \ldots z_m \end{pmatrix} \quad (37)$$

and I is the 3×3 identity matrix and where $\delta_i$ are the arbitrary real coefficients of directional biasing signals.

The Equation (36) may alternatively be written as:

$$\sum_{i=1}^{m} \alpha_i x_i = \sum_{i=1}^{m} \beta_i y_i = \sum_{i=1}^{m} \gamma_i z_i = \frac{kmr}{\sqrt{2}}, \sum_{i=1}^{m} \alpha_i y_i = \sum_{i=1}^{m} \alpha_i z_i =$$

$$\sum_{i=1}^{m} \beta_i x_i = \sum_{i=1}^{m} \beta_i z_i = \sum_{i=1}^{m} \gamma_i x_i = \sum_{i=1}^{m} \gamma_i y_i = 0.$$

In particular, the matrix M may be given by the equation:

$$\begin{pmatrix} \alpha_i \\ \beta_i \\ \gamma_i \end{pmatrix} = \frac{1}{\sqrt{2}} kmr \left\{ \sum_{h=1}^{m} \begin{pmatrix} x_h^2 & x_h y_h & x_h z_h \\ x_h y_h & y_h^2 & y_h z_h \\ x_h z_h & y_h z_h & z_h^2 \end{pmatrix} \right\}^{-1} \begin{pmatrix} x_i \\ y_i \\ z_i \end{pmatrix} \quad (38)$$

A matrix M satisfying Equation 36 yields correct localisation according to all major low frequency localisation theories provided that the constant k is chosen to ensure that:

$$k^2\{(Re(X'/W'))^2 + (Re(Y'/W'))^2 + (Re(Z'/W'))^2\} = 2 \quad \ldots (39)$$

for encoded sounds.

The constant k may be implemented by means of gain or shelf filter circuits affecting the signals X', Y', Z' and W′ prior to the final output matrix circuitry, and additional changes of gain, phase response and frequency response may be applied to these signals, provided that all the signals are affected equally by these additional changes.

For horizontally encoded sounds, Z=0, in which case the Z signal path may be omitted, and the system reduces to that previously described with reference to FIGS. 1 and 2, except that the values of $\alpha_i$ and $\beta_i$ may be somewhat altered in accordance with Equation 36.

FIG. 4 indicates an irregular octahedral layout of six loudspeakers F, B, LU, LD, RU and RD placed at a distance r from a reference point and respectively disposed in front, behind, at an angle $\phi$ above due left, at an angle $\phi$ below due left, at an angle $\phi$ above due right, and at an angle $\phi$ below due right. The corresponding loudspeaker feed signals $S_1+$, $S_1-$, $S_2+$, $S_3-$, $S_3+$, $S_2+$, are fed to the loudspeakers at $\pm$ ($x_i$, $y_i$, $z_i$) where:

$$(x_1, y_1, z_1) = (r, 0\ 0) \tag{40}$$

$$(x_2, y_2, z_2) = (0, r\cos\phi, r\sin\phi)$$

$$(x_3, y_3, z_3) = (0, -r\cos\phi, r\sin\phi)$$

Use of the above-mentioned matrix Formula 38 gives:

$$\begin{pmatrix} \alpha_1\ \beta_1\ \gamma_1 \\ \alpha_2\ \beta_2\ \gamma_2 \\ \alpha_3\ \beta_3\ \gamma_3 \end{pmatrix} = \frac{k}{\sqrt{2}} \begin{pmatrix} 3 & 0 & 0 \\ 0 & \frac{3}{2\cos\phi} & \frac{3}{2\sin\phi} \\ 0 & -\frac{3}{2\cos\phi} & \frac{3}{2\sin\phi} \end{pmatrix} \tag{41}$$

so that the loudspeaker feed signals are:

$$S_1^+ = W' + \frac{3k}{\sqrt{2}} X' \tag{42}$$

$$S_1^- = W' - \frac{3k}{\sqrt{2}} X'$$

$$S_2^+ = W' + \frac{3k}{2\sqrt{2}\cos\phi} Y' + \frac{3k}{2\sqrt{2}\sin\phi} Z'$$

$$S_2^- = W' - \frac{3k}{2\sqrt{2}\cos\phi} Y' - \frac{3k}{2\,2\sin\phi} Z'$$

$$S_3^+ = W' - \frac{3k}{2\sqrt{2}\cos\phi} Y' + \frac{3k}{2\sqrt{2}\sin\phi} Z'$$

$$S_3^- = W' + \frac{3k}{2\sqrt{2}\cos\phi} Y' - \frac{3k}{2\sqrt{2}\sin\phi} Z'$$

FIG. 5 illustrates a decoder for use in the case when the signal W has unit gain for sounds encoded from all directions in space, and where X, Y and Z have respective gains $\sqrt{2}\cos\theta\cos\eta$, $\sqrt{2}\sin\theta\cos\eta$ and $\sqrt{2}\sin\eta$ for sounds having source azimuth $\theta$ measured anticlockwise from due front and source elevation measured upwards from horizontal such as may occur in the decoders of certain four-channel encoding systems with full-sphere directionality. The signals W, X, Y and Z are produced from the received input signals by a WXYZ circuit 40. The W signal is applied to a type I shelf filter 42 while the X, Y and Z signals are applied to respective type II shelf filters 44, 46 and 48. The function of the shelf filters 42 to 48 is analogous to that of shelf filters 12, 14 and 16 of FIG. 1 and the transition frequency between low and high frequency gains is preferably centred at about 350 Hz, the shelf filters of both types having unity gain at low frequencies while the type I shelf filter has gain $\sqrt{2}$ and the type II shelf filters have gain $\sqrt{\frac{2}{3}}$ at frequencies well above the transition frequencies. The ratio of gains of the type II shelf filters to the type I shelf filter may be considered to implement a part of the factor k referred to in Equations (41) and (42). In this case it will be seen that k is a frequency dependent gain. The X, Y and Z signal paths also include High-pass filters 50, 52 and 54 to compensate for sound field curvature due to finite loudspeaker distance as previously described.

The X, Y and Z signal paths also include amplifiers 56, 58 and 60 applying respective gains I, II and III in order to implement matrix Equation 35. For the loudspeaker layout of FIG. 4, these gains are given by:

$$\text{gain } I = \frac{3}{\sqrt{2}}$$

$$\text{gain } II = \frac{3}{2\sqrt{2}\cos\phi}$$

$$\text{gain } III = \frac{3}{2\sqrt{2}\sin\phi}$$

The output signals in the Y and Z channels from the amplifiers 58 and 60 respectively are added by an addition circuit 62 to give the difference signals for the LU and RD pair of loudspeakers, and subtracted by a subtraction circuit 64 to obtain the difference signal for the RU and LD pair of loudspeakers. The output signal in the X channel, from the amplifier 56, itself constitutes the difference signal for the F and B pair of loudspekers. Each of these differences signals is combined by a respective addition circuit 66, 68 and 70 to give the signals $S_1+$, $S_2+$, and $S_3+$ which are amplified by respective power amplifiers 72, 74 and 76 and fed through the loudspeakers F, LU and RU.

The output signal in the W channel from the shelf filter 42 is also applied to an amplifier 78 having a gain of 2 and thence to a power amplifier 80 having equal gain to that of the power amplifiers 72, 74 and 76. Each of the signals $S_1+$, $S_2+$, and $S_3+$ is subtracted from the output of the amplifier 80 by connecting a respective one of the loudspeakers B, RD and LD between the output of the amplifier 80 and the output of the corresponding one of the amplifiers 72, 74 and 76. Thus only four power amplifiers are needed to feed the six loudspeakers. This so-called loudspeaker matrixing technique forms the subject of U.K. Pat. No. 1,548,674 and may also be applied to decoders for feeding horizontal loudspeaker arrays in accordance with the present invention, such as the decoder illustrated in FIGS. 2 and 3. It is often desirable to incorporate variable gain means for matching a range of loudspeaker arrangements by adjusting the gains of the signals X′, Y′ and Z′ before they are fed to the matrix circuit. A first variable gain circuit may be provided for multiplying the signal X′ by the gain coefficient $\alpha_1$, a second variable gain circuit may be provided for multiplying the signal Y′ by the gain coefficients $\beta_2$ and $\beta_3$, and a third variable gain circuit may be provided for multiplying the signal Z′ by the gain coefficients $\gamma_2$ and $\gamma_3$.

It will be appreciated that other spatial orientations of the octahedral layout of FIG. 4 may be used, provided that the signals X, Y and Z are matrixed or interchanged to correspond to components of sound velocity along the reorientated spatial axes.

The invention may also be applied to more complex irregular loudspeaker layouts. For example,the invention may be applied to a three dimensional layout of eight loudspeakers LF, RF, LB, RB, LU, LD, RU and RD as shown in FIG. 6, placed at the cartesian co-ordinates ($x_i$, $y_i$, $z_i$) and ($-x_i$, $-y_i$, $-z_i$) with respective feed signals $S_i+$ and $S_i-$ of the form given in Equations (33) and (34), where i has the values 1 to 4, and where, for radius r:

$$(x_1, y_1, z_1) = (r\cos\phi, r\sin\phi, o) \tag{44}$$

$$(x_2, y_2, z_2) = (r\cos\phi, -r\sin\phi, o)$$

$$(x_3, y_3, z_3) = (o, r\cos\xi, r\sin\xi)$$

$$(x_4, y_4, z_4) = (0, -r\cos\xi, r\sin\xi)$$

This corresponds to a loudspeaker layout consisting of a combination of a horizontal array of four loudspeakers with an angle $2\phi$ subtended at the centre by the front loudspeaker pair, and a vertical rectangular array of four loudspeakers with an angle $2\xi$ subtended at the centre by one of the vertical loudspeaker pairs.

Such a loudspeaker layout can be made to satisfy the directional requirements of the Makita and energy vector theories if one applies Equation (38) to the layout. A calculation then shows that:

$$\begin{pmatrix} \alpha_1 & \beta_1 & \gamma_1 \\ \alpha_2 & \beta_2 & \gamma_2 \\ \alpha_3 & \beta_3 & \gamma_3 \\ \alpha_4 & \beta_4 & \gamma_4 \end{pmatrix} = \sqrt{2}\,k \begin{pmatrix} 1/\cos\phi & \sin\phi/(\sin^2\phi + \cos^2\xi) & 0 \\ 1/\cos\phi & -\sin\phi/(\sin^2\phi + \cos^2\xi) & 0 \\ 0 & \cos\xi/(\sin^2\phi + \cos^2\xi) & 1/\sin\xi \\ 0 & -\cos\xi/(\sin^2\phi + \cos^2\xi) & 1/\sin\xi \end{pmatrix}$$

so that the loudspeaker feed signals are given by Equations (33) and (34) by using these values of $\alpha_i$, $\beta_i$, $\gamma_i$ for a suitable positive gain k (which may be chosen to be frequency dependent).

FIG. 7 illustrates a decoder for use with a variety of three dimensional loudspeaker layouts in accordance with this invention, including those described above in reference to FIGS. 4 and 6. This decoder is also suitable for use with a cuboid of loudspeakers as described in U.K. Patent Nos. 1,494,751 and 1,494,752 and incorporates a WXYZ circuit 90, type I and II shelf filters 92, 94, 96 and 98 and also high-pass filters 100, 102 and 104 to compensate for loudspeaker distance as described in the aforementioned specifications. The decoder also incorporates a switchable amplitude matrix 114. By providing several variable gain amplifiers 106, 108, 110 and 112, and by making the output amplitude matrix coefficients switchable to match the type of loudspeaker layout chosen, a single decoder can be made which is suitable for a number of different loudspeaker layouts. In particular, the variable gain amplifiers permit adjustment of the angles $\frac{1}{8}$ and $\xi$ describing the exact shape of the loudspeaker layout and thus act as a "layout control". The variable gain amplifier 106 multiplies the signal X' by the gain coefficients $\alpha_1$ and $\alpha_2$, the variable gain amplifier 108 multiplies the signal Y' by the gain coefficients $\beta_1$ and $\beta_2$, the variable gain amplifier 110 multiplies the signal Y' by the gain coefficient $\beta_3$ and $\beta_4$, and the variable gain amplifier 112 multiplies the signal Z' by the gain coefficients $\gamma_3$ and $\gamma_4$.

Any of the decoders described above can be used in conjunction with additional gain and time delay circuitry which serves to modify the output signals from the decoder prior to feeding these to the loudspeakers in order to compensate for loudspeakers at unequal distances from the common reference point, in accordance with the provisions of U.K. Pat. No. 1,552,478.

It will also be appreciated that the designation of the x-axis as being "forward", the y-axis as being "leftward" and the z-axis as being "upward" in this specification is purely arbitrary, and that x, y and z axes could equally as well be chosen to be any other set of 3 orthogonal cartesian axes at the common reference point. Thus, for example, by making the x-axis point leftward and the y-axis point forward, the decoders described with reference to FIGS. 3 to 6 will be suitable for alternative orientations of loudspeaker layouts. Thus, the L loudspeaker of FIG. 3 will become a front loudspeaker, the R loudspeaker will become a back loudspeaker, and the left front, left back, right front, right back loudspeakers will become respectively left front, right front, left back and right back loudspeakers. In a similar way, the octahedral layout of FIG. 4 will consist of front and back vertical pairs of speakers and one loudspeaker at each side. Finally, the layout of FIG. 6 will consist of front and back vertical pairs of loudspeakers and left and right side pairs of loudspeakers.

It will also be appreciated that the amplitude matrix described above may also incorporate any additional overall gain (including phase inversion where appropriate) such as might be considered desirable by one skilled in the art.

I claim:

1. A decoder for feeding an array of m (being three or more) pairs of diametrically opposite loudspeakers, the array being an irregular array, that is an array in which the loudspeakers are disposed in positions other than at the corners of a regular polygon or regular solid or a rectangle or rectangular cuboid, each loudspeaker being disposed substantially at an equal distance r from a common reference point, and the ith pair of loudspeakers having cartesian coordinates ($x_i$, $y_i$, $z_i$) and ($-x_i$, $-y_i$, $-z_i$) with respect to rectangular cartesian axes x, y and z at the reference point, said decoder comprising input means for receiving coded input signals representative of the desired acoustical pressure and velocity at the reference point and for outputting signals W, X, Y and, for a three-dimensional loudspeaker layout, Z, filter means connected to the input means for producing, from said signals W, X, Y, Z, a signal W' representative of the desired acoustical pressure at the reference point and independent of i, signals X', Y' and, where appropriate, Z' representative of the components of the desired acoustical velocity along the x, y and z axes and independent of i, and a signal $jW_i''$ bearing a 90° phase relationship to W' for all encoded sound directions, and an amplitude matrix circuit connected to the filter means for producing, from the output signals of said filter means, signals $S_i+$ and $S_i-$ to be fed to the loudspeakers of each pair, the sum of which is the same for all pairs of loudspeakers, where $$S_i+ = W' + \alpha_i X' + \beta_i Y' + \gamma_i Z' - \delta_{ij} W_i''$$

$$S_i- = W' - \alpha_i X' - \beta_i Y' - \gamma_i Z' + \delta_{ij} W_i''$$

where $\alpha_i$, $\beta_i$, $\gamma_i$, and $\delta_i$ are real gain coefficients such that $\alpha_i$, $\beta_i$ and $\gamma_i$ substantially satisfy the following matrix equation:

$$KM = \frac{k\,mr\,I}{\sqrt{2}}$$

where K is the m×3 matrix:

$$\begin{pmatrix} x_1 & x_2 & x_m \\ y_1 & y_2 \cdots & y_m \\ z_1 & z_2 & z_m \end{pmatrix},$$

M is the 3×m matrix of coefficients:

$$\begin{pmatrix} \alpha_1 & \beta_1 & \gamma_1 \\ \alpha_2 & \beta_2 & \gamma_2 \\ \vdots & & \\ \alpha_m & \beta_m & \gamma_m \end{pmatrix},$$

I is the identity matrix:

$$\begin{pmatrix} 1 & 0 & 0 \\ 0 & 1 & 0 \\ 0 & 0 & 1 \end{pmatrix}$$ for a three-dimensional loudspeaker layout or $$\begin{pmatrix} 1 & 0 & 0 \\ 0 & 1 & 0 \\ 0 & 0 & 0 \end{pmatrix}$$ for a two-dimensional, horizontal loudspeaker layout, and k is a positive real constant which may be frequency dependent.

2. A decoder according to claim 1, wherein the signal $jW_i''$ produced by the filter means is the same for all pairs of diametrically opposite loudspeakers.

3. A decoder according to claim 1, for a two-dimensional loudspeaker layout, the ith pair of loudspeakers of which has cartesian coordinates $(x_i, y_i)$ and $(-x_i, -y_i)$ with respect to rectangular cartesian axes x and y at the reference point, wherein the amplitude matrix circuit produces signals $$S_i^+ = W' + \alpha_i X' + \beta_i Y' - \delta_i jW_i''$$

$$S_i^- = W' - \alpha_i X' - \beta_i Y' + \delta_i jW_i''$$

where $\alpha_i$, $\beta_i$ and $\delta_i$ are real gain coefficients such that $\alpha_i$ and $\beta_i$ substantially satisfy the following equations:

$$\sum_{i=1}^{m} \alpha_i x_i = \sum_{i=1}^{m} \beta_i y_i = \frac{kmr}{\sqrt{2}}$$

$$\sum_{i=1}^{m} \alpha_i y_i = \sum_{i=1}^{m} \beta_i x_i = 0.$$

4. A decoder according to claim 3, wherein the amplitude matrix circuit produces signals; the gain coefficients $\alpha_i$ and $\beta_i$ of which are substantially given by the matrix equations:

$$\begin{pmatrix} \alpha_i \\ \beta_i \end{pmatrix} = \frac{1}{\sqrt{2}}\, kmr \left( \sum_{h=1}^{m} \begin{pmatrix} x_h^2 & x_h y_h \\ x_h y_h & y_h^2 \end{pmatrix} \right)^{-1} \begin{pmatrix} x_i \\ y_i \end{pmatrix}$$

where the power −1 indicates the matrix inverse.

5. A decoder according to claim 3, wherein the amplitude matrix is such that, considering the signal W′ as having unity gain and incorporating encoded sounds from all directions, the signal X′ has gain $\sqrt{2}\cos\theta$, and the signal Y′ has gain $\sqrt{2}\sin\theta$ for a sound originating from an azimuth $\theta$.

6. A decoder according to claim 3, wherein the filter means incorporates a first shelf filter circuit for producing the signal W′, and identical second shelf filter circuits are provided for producing the signals X′ and Y′.

7. A decoder according to claim 6, wherein the first and second shelf filter circuits have substantially identical phase responses at all audio frequencies.

8. A decoder according to claim 3, wherein the amplitude matrix circuit is such as to ensure that the constant k at low frequencies satisfies the equation:

$$k^2\{(\mathrm{Re}\,(X'/W'))^2 + (\mathrm{Re}\,(Y'/W'))^2\} = 2$$

for all horizontal sounds encoded into the signals W′, X′ and Y′, where Re denotes "the real part of".

9. A decoder according to claim 4, for feeding respective signals $S_1+$, $S_1-$, $S_2+$, $S_2-$, $S_3+$ and $S_3-$ to an irregular arrangement of six loudspeakers placed at the cartesian coordinates $\pm(x_i, y_i)$ where $$(x_1, y_1) = (-r\cos\phi,\ r\sin\phi)$$
$$(x_2, y_2) = (0,\ r)$$
$$(x_3, Y_3) = (r\cos\phi,\ r\sin\phi)$$

wherein the signals produced by the amplitude matrix circuit satisfy the equation:

$$\begin{pmatrix} \alpha_1 & \beta_1 & \gamma_1 \\ \alpha_2 & \beta_2 & \gamma_2 \\ \alpha_3 & \beta_3 & \gamma_3 \\ \alpha_4 & \beta_4 & \gamma_4 \end{pmatrix} = \sqrt{2}\, k \begin{pmatrix} 1/\cos\phi & \sin\phi/(\sin^2\phi + \cos^2\xi) & 0 \\ 1/\cos\phi & -\sin\phi/(\sin^2\phi + \cos^2\xi) & 0 \\ 0 & \cos\xi/(\sin^2\phi + \cos^2\xi) & 1/\sin\xi \\ 0 & -\cos\xi/(\sin^2\phi + \cos^2\xi) & 1/\sin\xi \end{pmatrix}$$

10. A decoder according to claim 3, wherein the amplitude matrix circuit comprises variable gain means for matching a range of loudspeaker arrangements by adjusting the gains of the signals X′ and Y′ before they are fed into a fixed matrix circuit.

11. A decoder according to claim 9, wherein a first variable gain circuit is provided for multiplying the signal X′ by the gain coefficients $\alpha_1$ and $\alpha_3$, a second variable gain circuit is provided for multiplying the signal Y′ by the gain coefficient $\beta_2$, and a third variable gain circuit is provided for multiplying the signal Y′ by the gain coefficients $\beta_1$ and $\beta_3$.

12. A decoder according to claim 1, for a three-dimensional loudspeaker layout, wherein the amplitude matrix circuit produces signals such that the gain coefficients $\alpha_i$, $\beta_i$ and $\gamma_i$ substantially satisfy the following equations:

$$\sum_{i=1}^{m} \alpha_i x_i = \sum_{i=1}^{m} \beta_i y_i = \sum_{i=1}^{m} \gamma_i z_i = \frac{kmr}{\sqrt{2}},\ \sum_{i=1}^{m} \alpha_i y_i = \sum_{i=1}^{m} \alpha_i z_i =$$

-continued $$\sum_{i=1}^{m} \beta_i x_i = \sum_{i=1}^{m} \beta_i z_i = \sum_{i=1}^{m} \gamma_i x_i = \sum_{i=1}^{m} \gamma_i y_i = 0.$$

13. A decoder according to claim 12, wherein the amplitude matrix circuit produces signals such that the gain coefficients $\alpha_i$, $\beta_i$ and $\gamma_i$ are substantially given by the matrix equations:

$$\begin{pmatrix} \alpha_i \\ \beta_i \\ \gamma_i \end{pmatrix} = \frac{1}{\sqrt{2}} kmr \left( \sum_{h=1}^{m} \begin{pmatrix} x_h^2 & x_h y_h & x_h z_h \\ x_h y_h & y_h^2 & y_h z_h \\ x_h z_h & y_n z_h & z_h^2 \end{pmatrix} \right)^{-1} \begin{pmatrix} x_i \\ y_i \\ z_i \end{pmatrix}$$

where the power $-1$ indicates the matrix inverse.

14. A decoder according to claim 12, wherein the amplitude matrix circuit is such that, considering the signal W' as having unity gain and incorporating sounds from all directions, the signals X', Y' and Z' have gains $\sqrt{2}\cos\theta\cos\eta$, $\sqrt{2}\sin\theta\cos\eta$ and $\sqrt{2}\sin\eta$ for a sound having a source azimuth $\theta$ measured anticlockwise from the x-axis and a source elevation $\eta$ measured upward from the xy-plane to the x-axis.

15. A decoder according to claim 12, wherein the filter means incorporates a first shelf filter circuit for producing the signal W' and identical second shelf filter circuits are for producing the signals X', Y' and Z'.

16. A decoder according to claim 15, wherein the first and second shelf filter circuits have substantially identical phase responses at all audio frequencies.

17. A decoder according to claim 12, wherein the amplitude matrix circuit is such as to ensure that the constant k at low frequencies satisfies the equation:

$$k^2 \{(Re\,(X'/W'))^2 + (Re\,(Y'/W'))^2 + (Re\,(Z'/W'))^2\} = 2$$

for all directional sounds encoded into the signals W', X', Y' and Z'.

18. A decoder according to claim 13, for feeding respective signals $S_1+$, $S_1-$, $S_2+$, $S_2-$, $S_3+$ and $S_3-$ to an irregular arrangement of six loudspeakers placed at the vertices of an irregular octahedron at a distance r from the origin of the cartesian coordinates.

19. A decoder according to claim 12, wherein the amplitude matrix circuit comprises variable gain means for matching a range of loudspeaker arrangements by adjusting the gains of the signals X', Y' and Z' before they are fed into a fixed matrix circuit.

20. A decoder according to claim 18, wherein the loudspeaker coordinates are $\pm(x_i, y_i, z_i)$ where $$(x_1, y_1, z_1) = (r, O, O)$$

$$(x_2, y_2, z_2) = (O, r\cos\phi, r\sin\phi)$$

$$(x_3, y_3, z_3) = (O, -r\cos\phi, r\sin\phi)$$

and the signals produced by the amplitude matrix circuit satisfy the equation:

$$\begin{pmatrix} \alpha_1 & \beta_1 & \gamma_1 \\ \alpha_2 & \beta_2 & \gamma_2 \\ \alpha_3 & \beta_3 & \gamma_3 \\ \alpha_4 & \beta_4 & \gamma_4 \end{pmatrix} = \sqrt{2}\, k \begin{pmatrix} 1/\cos\phi & \sin\phi/(\sin^2\phi + \cos^2\xi) & 0 \\ 1/\cos\phi & -\sin\phi/(\sin^2\phi + \cos^2\xi) & 0 \\ 0 & \cos\xi/(\sin^2\phi + \cos^2\xi) & 1/\sin\xi \\ 0 & -\cos\xi/(\sin^2\phi + \cos^2\xi) & 1/\sin\xi \end{pmatrix}.$$

21. A decoder according to claim 19, wherein a first variable gain circuit is provided for multiplying the signal X' by the gain coefficient $\alpha_1$, a second variable gain circuit is provided for multiplying the signal Y' by the gain coefficient $\beta_2$ and $\beta_3$, and a third variable gain circuit is provided for multiplying the signal Z' by the gain coefficients $\gamma_2$ and $\gamma_3$.

22. A decoder according to claim 18, wherein four power amplifiers having one output terminal in common are provided for receiving signals $S_1+$, $S_2+$, $S_3+$, the power amplifiers being connected to the six loudspeakers such that each of the loudspeakers requiring signals $S_1+$, $S_2+$ and $S_3+$ is driven by a respective amplifier and each of the diametrically opposite loudspeakers requiring signals $S_1-$, $S_2-$ and $S_3-$ is driven by having one terminal of the loudspeaker coupled to the non-common output terminal of a respective amplifier and the other terminal of the loudspeaker coupled to the non-common output terminal of the amplifier provided for receiving the signal 2W'.

23. A decoder according to claim 13, for feeding respective signals $S_1+$, $S_1-$, $S_2+$, $S_2-$, $S_3+$, $S_3-$, $S_4+$ and $S_4-$ to an irregular arrangement of eight loudspeakers placed at the vertices of a rectangle in the xy-plane and at the vertices of a rectangle in the yz-plane at the cartesian coordinates $\pm(x_i, y_i, z_i)$ where $$(x_1, y_1, z_1) = (r\cos\phi, r\sin\phi, 0)$$

$$(x_2, y_2, z_2) = (r\cos\phi, -r\sin\phi, 0)$$

$$(x_3, y_3, z_3) = (O, r\cos\xi, r\sin\xi)$$

$$(x_4, y_4, z_4) = (O, -r\cos\xi, r\sin\xi)$$

wherein the signals produced by the amplitude matrix circuit satisfy the equation:

$$\begin{pmatrix} \alpha_1 & \beta_1 & \gamma_1 \\ \alpha_2 & \beta_2 & \gamma_2 \\ \alpha_3 & \beta_3 & \gamma_3 \\ \alpha_4 & \beta_4 & \gamma_4 \end{pmatrix} = \sqrt{2}\, k \begin{pmatrix} 1/\cos\phi & \sin\phi/(\sin^2\phi + \cos^2\xi) & 0 \\ 1/\cos\phi & -\sin\phi/(\sin^2\phi + \cos^2\xi) & 0 \\ 0 & \cos\xi/(\sin^2\phi + \cos^2\xi) & 1/\sin\xi \\ 0 & -\cos\xi/(\sin^2\phi + \cos^2\xi) & 1/\sin\xi \end{pmatrix}$$

24. A decoder according to claim 23, adjustable for a range of values of the angles $\phi$ and $\xi$, wherein the amplitude matrix circuit comprises adjustment means for matching a range of loudspeaker arrangements by adjusting the gains of the signals X', Y' and Z' before they are fed into a fixed matrix circuit, and wherein a first variable gain circuit is provided for multiplying the signal X' by the gain coefficients $\alpha_1$ and $\alpha_2$, a second variable gain circuit is provided for multiplying the signal Y' by the gain coefficients $\beta_1$ and $\beta_2$, a third variable gain circuit is provided for multiplying the signal Y' by the gain coefficients $\beta_3$ and $\beta_4$, and a fourth variable gain circuit is provided for multiplying the signal Z' by the gain coefficients $\gamma_3$ and $\gamma_4$.

* * * * *